United States Patent [19]

Gibbs

[11] Patent Number: 4,819,289

[45] Date of Patent: Apr. 11, 1989

[54] RIFLE FIELD SERVICE TOOL

[75] Inventor: Philip W. Gibbs, Camillus, N.Y.

[73] Assignee: Camillus Cutlery Co., Syracuse, N.Y.

[21] Appl. No.: 219,146

[22] Filed: Jul. 15, 1988

[51] Int. Cl.[4] ..... B25F 1/00

[52] U.S. Cl. ..... 7/118; 7/165; 81/176.1; 42/90

[58] Field of Search ..... 7/118, 165, 170; 81/3.05, 176.1, 176.2; 42/90, 106

[56] References Cited

U.S. PATENT DOCUMENTS 2,332,656 10/1943 Mirando ..... 7/118
3,742,533 7/1973 Burnette ..... 7/165

FOREIGN PATENT DOCUMENTS 878608 6/1953 Fed. Rep. of Germany ..... 7/118

*Primary Examiner*—Roscoe V. Parker
*Attorney, Agent, or Firm*—Charles S. McGuire

[57] ABSTRACT

A hand tool including a handle portion and a substantially flat blade having a plurality of curvilinear configurations spaced about the peripheral outline thereof for cooperatively engaging certain portions of a rifle to perform various operations thereon. The blade is attached at one end to the handle portion, preferably with a pivotal connection permitting opening and closing movement in the nature of a folding pocket knife. The blade includes a squared end serving as a screwdriver tip on the end opposite the pivotally mounted end, a convex curved portion between two linear portions on one longitudinal edge, and an outwardly projecting tip or pin adjoining a concave, curved portion on the other longitudinal edge serving as a spanner wrench. Each of these three portions of the blade is engageable with one or more portions of conventional rifles, and/or auxiliary equipment used therewith, to assist in adjustment, assembly, disassembly, or the like.

7 Claims, 2 Drawing Sheets

RIFLE FIELD SERVICE TOOL

BACKGROUND OF THE INVENTION

The present invention relates to small hand tools and, more specifically, to a tool for performing a plurality of operations involved in the field servicing of rifles or other firearms and auxiliary equipment such as sights, ammunition holders, etc. used therewith.

The design of certain firearms is such that some mechanism independent of the firearm itself is required to perform or assist in operations such as field stripping, sight adjustment, and the like. Although another item, e.g., a coin of suitable thickness, may sometimes provide a makeshift tool which will serve to perform some of the required functions, there is no guarantee that such items will be available when needed. Furthermore, since such items are not designed or intended as tools in the first place, they are not optimally suited to perform the functions to which they are put.

It is a principal object of the present invention to provide a small tool suited to perform or assist in a plurality of operations in connection with certain firearms.

Another object is to provide a hand tool of simple, one-piece design suited to assist in disassembling, assembling, adjusting, or like operations, of a particular design of rifle and auxiliary equipment used therewith.

A further object is to provide a tool useful in performing mechanical operations, particularly in connection with certain firearms, which may conveniently be combined with a handle portion in pivotally attached manner for movement between folded and unfolded positions.

Other objects will in part be obvious and will in part appear hereinafter.

SUMMARY OF THE INVENTION

The tool of the invention is designed for use with firearms having parts and/or auxiliary equipment, such as detachable sights and ammunition clips or magazines, which require engagement by separate devices for performing or assisting in certain operations. Such firearms include the M-16 and AR-15 assault rifles, both manufactured by Colt Firearms of Hartford, Conn., and the tool of the invention is shown and described in connection with these weapons. It will be understood, of course, that the tool may be used with any firearm having parts with which the various elements of the tool are compatible.

The tool comprises a flat, metal blade having a peripheral configuration with separate portions designed to perform different functions. The blade is somewhat elongated, having one end either formed integrally with or attached to a handle portion of the tool. In a preferred embodiment, the blade is pivotally attached to the handle portion for movement between folded and unfolded positions, in the manner of a folding pocket knife; one or more knife blades or other tool members may also be pivotally attached to the handle portion, as well as the tool blade of the present invention.

The end of the blade opposite its attachment to the handle portion is squared in the manner of a screwdriver bit. One longitudinal edge is formed with an outwardly curved, i.e., a convex, portion between two linear portions, one of which adjoins the squared end of the blade, to provide a flat wrench for engaging curved slots in the heads of threaded members. The opposite longitudinal edge is formed with a projecting tip or pin adjoining an inwardly curved or concave portion of the edge configuration. The pin may be engaged with a hole in the side of a threaded member with the tool serving as a spanner wrench. Multiple operations may thus be performed be the tool through engagement of the various portions of the blade periphery with parts of the firearm or its associated equipment.

DETAILED DESCRIPTION

Figure 1:
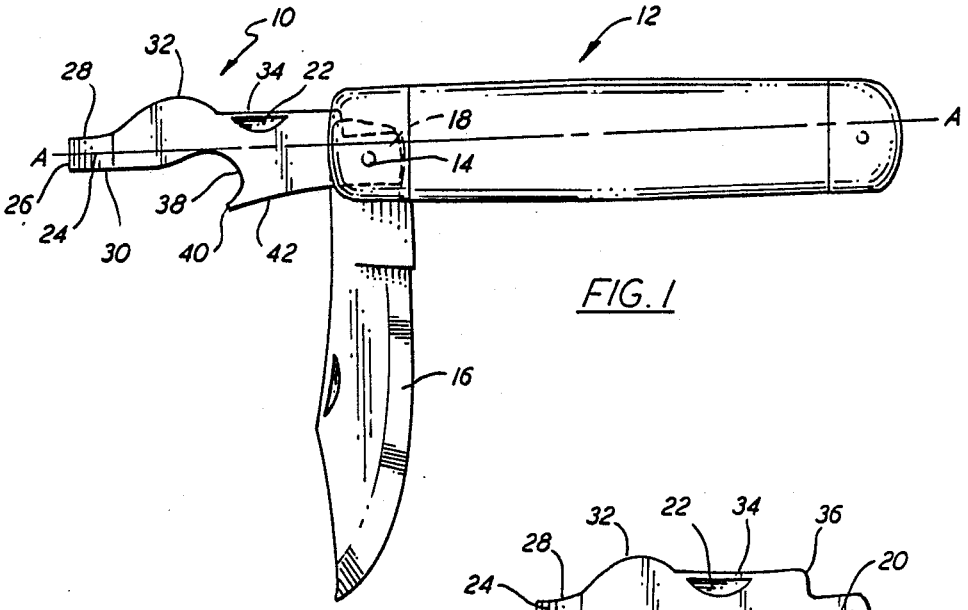
FIG. 1 is an elevational view of the tool in a preferred embodiment.
Figure 2:
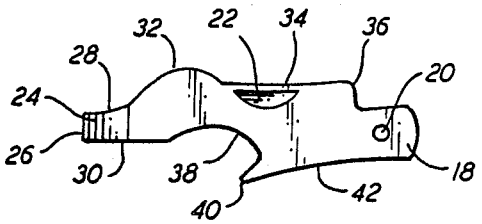
FIG. 2 is an elevational view of the tool blade.

As seen in FIGS. 1 and 2, the tool of the invention includes blade and handle portions, generally denoted by reference numerals 10 and 12, respectively. Blade 10 is formed from a flat piece of stainless steel or other suitable metal, having a substantially uniform thickness and edge configurations adapted to perform a plurality of functions, as described later. In the preferred embodiment blade 10 is pivotally connected to handle 12 by pin 14 and is movable between the extended position, shown in FIG. 1, and a folded position wherein most of the blade is positioned in a recess between two sections of handle in the manner of a folding pocket knife. In fact, blade 10 may comprise one of a plurality of folding blades or tools, such as knife blade 16, pivotally attached to handle 12 by pin 14 and/or another pin at the opposite end of the handle.

One end 18 of blade 10 is formed in the manner of a tang on the blade of a knife or other tool made for pivotal, folding movement with respect to a handle. Opening 20 in end 18 is provided for passage of pivot pin 14, and handle 12 includes he usual back spring (not shown) for over-center biasing of the blades to both the extended, or open, and closed, or folded, positions. Slot 22 is provided in a side surface of blade 10, adjacent one edge thereof, for engagement by the user's thumbnail to move the blade away from the closed position in the usual manner. Although blade 10 is shown, and preferred to be pivotally connected to handle 12, the two portions may be rigidly attached or, for that matter, integrally formed.

Blade 10 is somewhat elongated along axis A—A, having proximal end 18 for attachment to handle 12, and distal end 24, having forward edge 26 and side edges 28 and 30. Edge 26 is essentially perpendicular to axis A—A, and side edges 28 and 30 are parallel thereto, forming a screwdriver bit at end 24. In the orientation of blade 10 shown in FIGS. 1 and 2, the upper and lower longitudinal edges of the blade extending between edges 18 and 24 will be termed first and second edges, respectively.

The first edge extends rearwardly from linear edge 28 to curve outwardly, forming convex edge portion 32. Linear edge portion 34 extends from curved edge 32, parallel to axis A—A but spaced therefrom farther than edge 28. Linear edge 34 is joined to tang or proximal end portion 18 by edge portion 36 which seats against the end of the back spring to define the fully open position of blade 10 in the usual manner of folding knife blades or other implements.

The second edge of blade 10 extends from linear edge 30 to a concave, or inwardly curved edge portion 38. This edge then extends forwardly and downwardly to form relatively sharp point or tip 40, from which edge portion 42 extends in a very shallow, concave curve to join proximal end portion 18.

Figure 3:
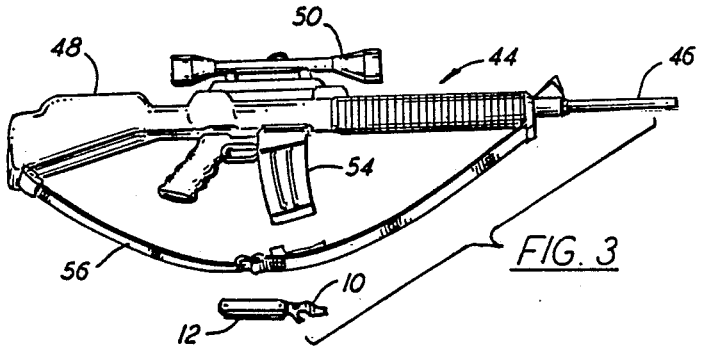
FIGS. 3–10 are perspective views of the tool and portions of a firearm and/or auxiliary equipment used therewith, illustrating various operations which the tool is adapted to perform.

Having thus described the configuration of blade 10, and its association with handle 12, attention is now directed to FIGS. 3–10 wherein the tool is illustrated in its intended manner of use. As previously stated, the tool is designed to perform or assist in a plurality of functions in connection with a firearm such as an M-16 or AR-15 assault rifle, and each of FIGS. 3–10 illustrate the tool in use performing a different function or operation. The tool is shown in FIG. 3 next to a rifle, denoted generally by reference numeral 44, of a type with which the tool is intended for use. Rifle 44 includes such elements as barrel 46, stock 48, removable telescopic sight or scope 50, hand grip 52, ammunition magazine 54 and sling 56.

Figure 4:
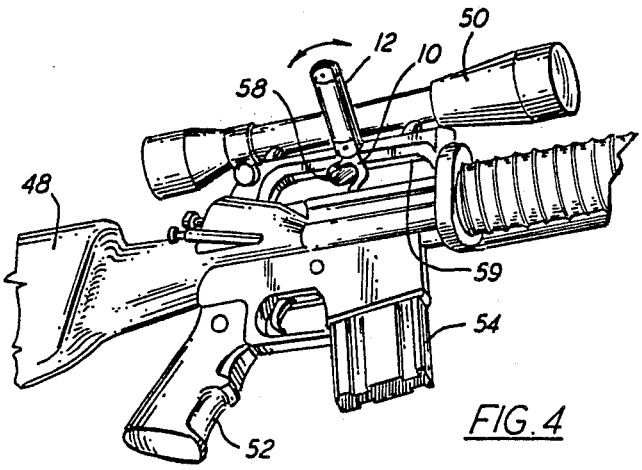

As shown in FIG. 4, scope 50 is mounted to the weapon by means of a round (cylindrical) nut 58 located inside the top of carry handle 59. Nut 58 has a plurality of openings (e.g., three) extending into the cylindrical surface thereof. Scope 50 is mounted upon and removed from the mount by tightening or loosening nut 58 by use of the spanner wrench portion of the tool. That is, tip 40 of blade 10 is placed in one of the openings in nut 58 and blade edge 30 in contact with the outer surface of the nut in the manner illustrated in FIG. 4 to effect clockwise rotation (tightening) of the bolt as the scope is mounted. The position of the tool is reversed to effect counter-clockwise rotation for removal of the nut and disassembly of the scope from its mount on rifle 44.

Figure 5:
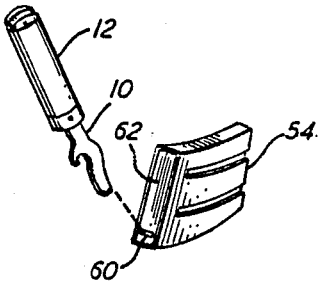
Figure 6:
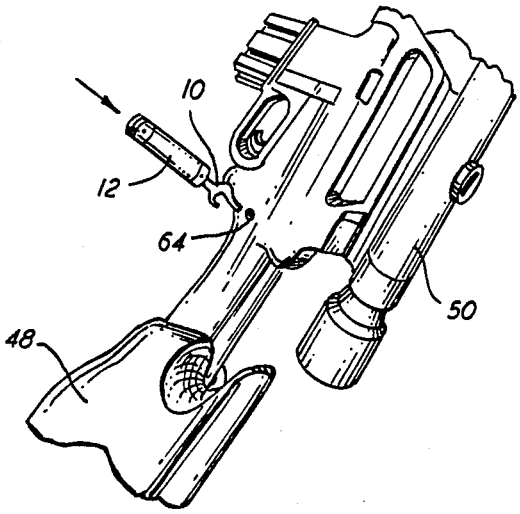

FIG. 5 illustrates how forward edge 26 of distal blade end 24 is engaged in slot 60 in base plate 62 of magazine 54 to slide the base plate away from the magazine body, thereby assisting in disassembly of the magazine components for cleaning or replacement. In the usual type of magazine, it is necessary to depress a lock tab (not shown) into the magazine body before engaging and sliding the base plate out of the magazine.

Rifle 44 comprises two major assemblies, i.e., the front end including barrel 46, and the rear end including stock 48, which are held together by transverse, knock-out pin 64. The two assemblies may be swung open for bolt removal and cleaning by removal of pin 64. This is done by engaging the end of pin 64 shown in FIG. 6 with forward edge 26 of blade 10 and pushing the pin out of the other end of the opening through which it extends. Distal end 24 of blade 10 has a transverse dimension between edges 28 and 30 less than the diameter of the pin opening, whereby the distal end of the blade may be fully inserted into the opening, causing pin 64 to protrude a sufficient distance out the opposite side of the opening to permit manual grasping and partial removal of the pin to an extent permitting hinged movement of the two sections of the rifle.

Figure 7:
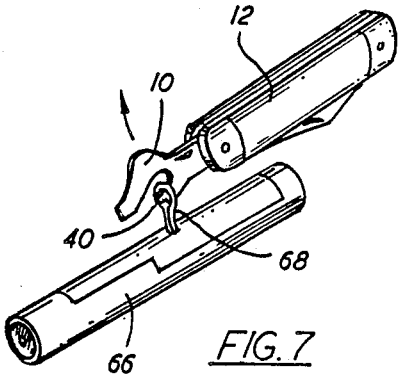

After the two major assemblies are swung open, bolt assembly 66, containing the firing pin, may be removed from the rear assembly. The firing pin may be removed from bolt 66 by removing cotter pin 68. As illustrated in FIG. 7, the open end of cotter pin 68 is engaged by tip 40 of blade 10, and the pin is lifted out of the bolt. Once the cotter pin is removed, the firing pin may be extracted from bolt assembly 66 for cleaning or repair.

Figure 8:
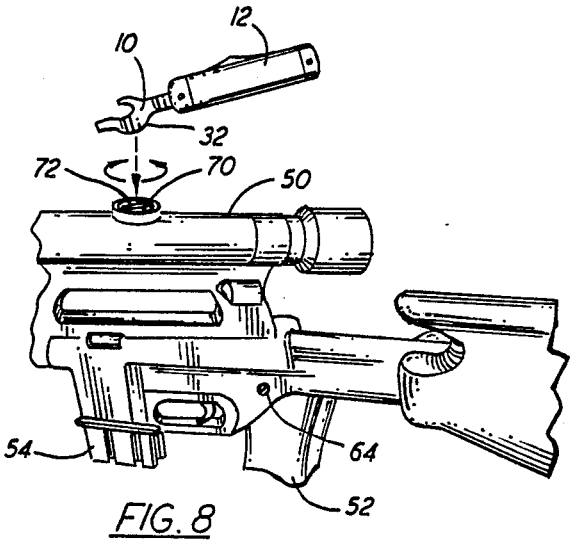

Windage and elevation adjustment of scope 50 is effected by turning one or more adjusting screws 70 a desired number of clicks in either direction. Screw 70 has slot 72 in the upper surface thereof. Slot 72 has a curved lower surface, with the ends of the slot essentially meeting the plane of the upper surface of adjusting screw 70. Convex edge portion 32 of blade 10 as a curvature substantially conforming to that of the lower surface of slot 72 and is placed in the slot to effect rotation of screw 70 in either direction, as indicated in FIG. 8. The screwdriver bit on the distal end of blade 10 may also be used for windage adjustment of the fixed sights (not shown) and for removal of the pivot screw to permit further disassembly of the weapon.

Figure 9:
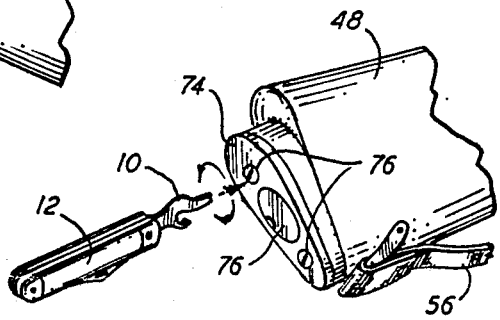
Figure 10:
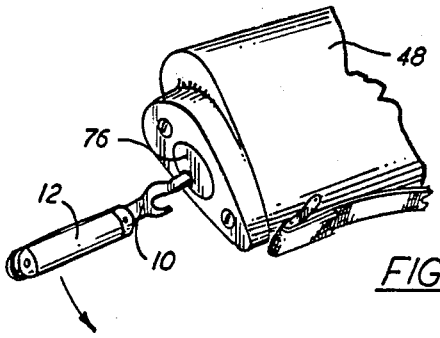

Butt stockpad 74 is secured to stock 48 by two screws 76, as shown in FIG. 9, and may be removed by using the screwdriver bit on distal end 24 of blade 10 to remove screws 76.

A compartment is provided in the end of stock 48 adjacent butt stockpad 74 for storing materials for cleaning rifle 44. The compartment is normally covered by hinged cover member 76 which is held in the closed position by a relatively strong spring. Cover member 76 may be easily moved to the open position by engaging the forward end of distal end 24 of blade 10 with a catch on the cover member and swinging the cover away from the closed position. In fact, the tool itself may be stored in the compartment to insure its availability when required to assist in the operations described herein. This requires, of course, that other means be used to open cover member 76 when the tool is stored in the compartment.

From the foregoing it will be seen that the objects and advantages of the invention are efficiently realized through a tool having a uniquely designed blade which cooperatively engages various portions of a standard type of firearm to effect or assist in assembly, disassembly, adjustment and other operations.

What is claimed is:

1. A hand tool for assisting in field servicing a firearm of conventional design, said tool comprising:

(a) an elongated handle portion extending along an axis between front and rear end portions;

(b) a substantially flat blade having a proxal end attached to said front end portion of said handle and extending therefrom along said axis to a distal end, said blade including:

(i) a forward, linear edge substantially perpendicular to said axis and having a predetermined width;

(ii) first and second longitudinal edges extending from said forward edge to said proxal end, each of said first and second edges including a first, linear portion extending from said forward edge perpendicularly thereto and parallel to one another, whereby said first linear portions are spaced from one another by said predetermined width;

(iii) a convex edge portion of said first edge, curved outwardly from said axis, and extending from said first linear portion of said first edge toward said proxal end;

(iv) a second linear portion of said first edge extending from said convex edge portion to said proxal end substantially parallel to said axis;

(v) a concave edge portion of said second longitudinal edge having a first portion curved inwardly toward said axis and extending from said first linear portion of said second longitudinal edge toward said proxal end, and a second portion curved inwardly toward said proxal end and extending from said first portion of said concave edge portion to a terminal end spaced farther from said axis than said first, linear portion of said second longitudinal edge;

(vi) a blunt tip directed toward said distal end on said second longitudinal edge of said blade at the terminus of said second portion of said concave edge portion; and (vii) a terminating edge portion of said second longitudinal edge extending from said blunt tip to said proxal end of said blade.

2. A hand tool according to claim 1 wherein said proxal end of said blade is pivotally connected to said front end portion of said handle for movement of said blade between folded and extended positions with respect to said handle.

3. A hand tool according to claim 2 wherein said handle includes a longitudinal recess wherein at least a major portion of said blade is disposed when in said folded position.

4. A hand tool according to claim 3 and further including a foldable knife blade pivotally attached to said handle.

5. A hand tool according to claim 2 wherein said proxal end of said blade is formed in the configuration of the tang of a folding knife blade.

6. A hand tool according to claim 5 wherein said terminating edge portion is curved slightly toward said axis, having a substantially less concave shape than said first portion of said concave edge portion.

7. A hand tool according to claim 6 wherein said second linear portion of said first edge is substantially parallel to, and spaced a greater distance from said axis than, said first linear portion of said first edge.

* * * * *